US009482418B2

(12) United States Patent
Zeng et al.

(10) Patent No.: US 9,482,418 B2
(45) Date of Patent: Nov. 1, 2016

(54) INTEGRATED LED MODULE

(71) Applicant: SHANGHAI YAMING LIGHTING CO.,LTD., Shanghai (CN)

(72) Inventors: Chuitong Zeng, Shanghai (CN); Liangcai Jia, Shanghai (CN); Xiaoliang Xu, Shanghai (CN); Baoquan Li, Shanghai (CN); Carnotensis Ludo, Shanghai (CN); Krijger De Sjef, Shanghai (CN)

(73) Assignee: SHANGHAI YAMING LIGHTING CO., LTD., Jiading District, Shanghai (CN)

( * ) Notice: Subject to any disclaimer, the term of this patent is extended or adjusted under 35 U.S.C. 154(b) by 0 days.

(21) Appl. No.: 14/416,882

(22) PCT Filed: Sep. 26, 2012

(86) PCT No.: PCT/CN2012/082010

§ 371 (c)(1),
(2) Date: Jan. 23, 2015

(87) PCT Pub. No.: WO2014/015561

PCT Pub. Date: Jan. 30, 2014

(65) Prior Publication Data

US 2015/0204528 A1 Jul. 23, 2015

(30) Foreign Application Priority Data

Jul. 24, 2012 (CN) ..... 2012 1 0258443
Aug. 7, 2012 (CN) ..... 2012 2 0388991 U

(51) Int. Cl.
*F21V 23/00* (2015.01)
*H05B 33/08* (2006.01)
(Continued)

(52) U.S. Cl.
CPC ..... *F21V 23/005* (2013.01); *F21K 9/30* (2013.01); *F21V 17/101* (2013.01); *F21V 29/74* (2015.01); *F21V 29/763* (2015.01); *H05B 33/0803* (2013.01); *H05B 33/083* (2013.01); *H05B 33/0815* (2013.01); *H05B 33/0827* (2013.01);
(Continued)

(58) Field of Classification Search
CPC .... F21K 9/30; F21Y 2105/001; F21V 17/12; F21V 23/00; F21V 23/003; F21V 23/005; F21V 29/00; F21V 29/74; F21V 29/503; F21V 29/763; F21V 31/005
See application file for complete search history.

(56) References Cited

U.S. PATENT DOCUMENTS 6,999,318 B2 * 2/2006 Newby ..... F21K 9/00 257/706
7,976,188 B2 * 7/2011 Peng ..... F21S 8/04 362/221

(Continued)

*Primary Examiner* — Peggy Neils
(74) *Attorney, Agent, or Firm* — Global IP Services; Tianhua Gu

(57) ABSTRACT

An integrated LED module at least comprises: a light-transmitting plate having a heat-conducting substrate and a transparent package; an LED array sealed in the light-transmitting plate; a drive circuit electrically connected to the LED array, and used for converting an external power supply into a 12V-75V forward voltage that drives each LED in the LED array; and a heat sink clinging to the light-transmitting plate. The integrated LED module solves the problem in the prior art that an LED lamp presented after assembly has a large size and is heavy as a part of the line of a drive power supply in the LED lamp is complicated, and further reduces material costs, saves processing and assembling time, and lowers production costs due to an integrally formed structure.

9 Claims, 6 Drawing Sheets

(51) Int. Cl.

| | |
|---|---|
| ***F21K 99/00*** | (2016.01) |
| ***F21V 29/74*** | (2015.01) |
| ***F21V 17/10*** | (2006.01) |
| ***F21V 29/76*** | (2015.01) |
| *F21V 29/503* | (2015.01) |
| *F21V 17/12* | (2006.01) |
| *F21Y 105/00* | (2016.01) |
| *F21V 31/00* | (2006.01) |
| *F21Y 101/02* | (2006.01) |

(52) U.S. Cl.
CPC ..... *F21V 17/12* (2013.01); *F21V 29/503* (2015.01); *F21V 31/005* (2013.01); *F21Y 2101/02* (2013.01); *F21Y 2105/001* (2013.01)

(56) References Cited

U.S. PATENT DOCUMENTS

| | | | | |
|---|---|---|---|---|
| 8,075,163 | B2 * | 12/2011 | Xiao | F21V 21/30 362/249.02 |
| 2006/0181878 | A1 * | 8/2006 | Burkholder | F21S 48/321 362/294 |
| 2008/0117647 | A1 * | 5/2008 | Behr | F21S 48/1109 362/547 |
| 2010/0110679 | A1 * | 5/2010 | Teng | F21K 9/00 362/235 |
| 2010/0135020 | A1 * | 6/2010 | Moore | A47F 11/10 362/249.02 |
| 2010/0270922 | A1 * | 10/2010 | Lin | F21V 29/004 315/32 |
| 2010/0277077 | A1 * | 11/2010 | Pong | H05B 33/0818 315/152 |

* cited by examiner

INTEGRATED LED MODULE

CROSS REFERENCE TO RELATED PATENT APPLICATION

The present application is the US national stage of PCT/CN2012/082010 filed on Sep. 26, 2012, which claims the priorities of the Chinese patent applications No. 201210258443.1 filed on Jul. 24, 2012 and No. 201220388991.1 filed on Aug. 7, 2012, which applications are incorporated herein by reference.

BACKGROUND OF THE PRESENT INVENTION

1. Field of Invention

The present invention relates to the field of light-emitting diode (LED) lighting, and specifically to an integrated LED module.

2. Description of Related Arts

At present, light sources for street lighting include an incandescent lamp, a high pressure mercury lamp, a high pressure sodium lamp, a metal halide lamp, a fluorescent lamp, and the like. These street lamps generally have the following disadvantages: they are less environmentally friendly (mercury, lead, arsenic and other heavy metals contained therein are harmful to the environment), have high energy consumption and a short service life. Therefore, with the enhancement of global environmental protection consciousness, in countries throughout the world, especially in developed countries and regions, environmentally friendly lighting is more widely applied, and an environmentally-friendly light source will gradually substitute for these street lamps. An LED module with a 3-5V forward voltage is an environmentally friendly light source that has high efficiency, saves energy, and has a long luminescence lifetime, which is of great significance to environmental protection, energy saving, and protection of human health.

As known in the industry, adjustment of the brightness of the LED module with a 3-5V forward voltage is implemented by adjusting a current flowing through an LED, and therefore a brightness control for the LED is usually implemented by controlling an output current of an LED drive circuit. At present, in the field of LED drivers with a 3-5V forward voltage, products vary in quality. In order to reduce a cost, some products are provided with a simple line, have a power factor merely reaching about 0.5, and incur low luminous efficiency, thereby failing to meet a demand for efficient and energy-saving products in market; and in order to meet a high performance requirement, some products have a very complicated circuit. Refer to FIG. 1, which is a schematic diagram of a principle of a drive circuit of a conventional LED module with a 3-5V forward voltage. As shown in FIG. 1, a conventional LED drive power supply includes an electromagnetic interference (EMI) unit 121, an analog/digital (A/D) conversion unit 122, an input and output isolation unit 123, a constant-voltage and constant-current output and overvoltage and overcurrent (an open circuit and a short circuit) protection unit 124, and a power factor correction (PFC) power supply 125, and the like. Because a large number of restrictive devices such as electrolytic capacitors and inductors are used in the above drive circuit, a line is rather complicated, it is difficult to lay a simple line, and the cost is greatly increased; furthermore, specific circuits of different products are also different and it is also highly difficult to develop a circuit, which increases development time; and because a part of the line of the drive power supply is complicated, a manufactured LED lamp is relatively large in size, which seriously affects an overall design of a lamp product and application flexibility thereof.

In the current LED lighting schemes, in order to drive an LED module to emit light, it is necessary to add a drive circuit, to generate an appropriate drive current. When the LED module continuously emits light, it may produce a lot of heat, and it is necessary to add a heat sink to make the LED module not overheat. However, in the current general lamp structure, an LED module, a drive circuit part, and a heat sink of the lamp are independent of each other. Refer to FIG. 2, which is a schematic structural exploded view of a conventional LED lamp. As shown in FIG. 2, the LED lamp structure consists of an LED module 10, a heat sink 11 disposed on the back of the LED module 10 and used for dissipating heat from the LED module 10, a power supply housing 12 for receiving a drive power supply, a light-transmitting shade 13 covering an out-light surface of the LED module, a lid body 14 for sealing the power supply housing, a suspension member 15 connected to the lid body, and the like. As stated above, as a part of the line of the drive power supply of the LED lamp is complicated, components of the LED lamp have to be packaged and integrated by using a large-size power supply housing 12, and due to separate structures of the components, a waste of material costs is incurred, and the LED lamp presented after assembly has a large size and is heavy, which is unconductive to construction of the lamps connected thereto, also prolongs processing and assembling time, and results in a waste of production costs.

SUMMARY OF THE PRESENT INVENTION

In view of the foregoing disadvantages in the prior art, an objective of the present invention is to provide an integrated LED module, so as to solve the problem in the prior art that an LED lamp presented after assembly has a large size and is heavy as a part of a line of a drive power supply in the LED lamp is complicated.

Another objective of the present invention is to provide an integrated LED module, which is used to solve the problem in the prior art that separate structures of the components in the LED lamp cause a waste of material costs, prolong processing and assembling time, and result in a waste of production costs.

In order to achieve the above objectives and other related objectives, the present invention provides an integrated LED module, where the integrated LED module at least comprises: a light-transmitting plate, having a heat-conducting substrate and a transparent package that covers the heat-conducting substrate and has a built-in space; an LED array, laid on a circuit board and sealed in the light-transmitting plate by the transparent package; a drive circuit, laid on the circuit board, sealed in the light-transmitting plate by the package, electrically connected to the LED array by the circuit board, and used for converting an external power supply into a 12V-75V forward voltage that drives each LED in the LED array; and a heat sink, having a heat-conducting surface clinging to the light-transmitting plate and a plurality of heat-dissipation fins integrally formed with the heat-conducting surface.

The integrated LED module in accordance with the present invention further comprises a control panel disposed on the heat-dissipation fins, which is electrically connected to the drive circuit and used for outputting a control instruction to the drive circuit, so that the drive circuit is in control of the LED array to be turned on or turned off, or to adjust brightness or color temperature.

In the LED module in accordance with the present invention, the plurality of heat-dissipation fins of the heat sink has notches, to form slots for retaining the control panel.

In the LED module in accordance with the present invention, a periphery of the transparent package has a flange, four corners of the flange are provided with through holes, and the heat-conducting surface of the heat sink has screw holes corresponding to the through holes.

The LED module in accordance with the present invention further comprises a seal ring, which is circularly disposed on the periphery of the heat-conducting substrate and the circuit board, and is pressed between the transparent package and the heat sink to seal a gap therebetween.

In the LED module in accordance with the present invention, the light-transmitting plate clings to the heat-conducting surface of the heat sink by screw locking, bonding or fastening.

In the LED module in accordance with the present invention, the heat-conducting surface of the heat sink and the light-transmitting plate have a heat-conducting medium therebetween, where the heat-conducting medium is a heat-conducting glue, a heat-conducting grease, or a heat-conducting pad.

In the LED module in accordance with the present invention, power of each LED in the LED array is 1 W-4 W, and the LED array is a square, rectangular, circular or elongated array arranged by a plurality of singly packaged LEDs, or a square, rectangular, circular or elongated array arranged by LEDs packaged by LED chips on board (COB).

In the LED module in accordance with the present invention, the LED array comprises a plurality of parallel groups formed by a plurality of LEDs connected in parallel, where the parallel groups are connected in series.

In the LED module in accordance with the present invention, the drive circuit comprises: a power supply module, connected to an external alternating current (AC) or direct current (DC) power supply and the LED array, comprising a rectifying unit and an overcurrent overvoltage protection unit connected to the rectifying unit, and used for converting the external power supply into a 12V-75V forward voltage that drives each LED in the LED array; and a control module connected between the power supply module and the LED array, and comprising a plurality of gating switches and a control unit, where the gating switches are disposed corresponding to the parallel groups and used for conducting or cutting off power supply loops of the parallel groups, and the control unit is used for controlling the gating switches to perform a conduction or cutoff operation according to a detected input voltage. The control module further comprises a detection unit used for outputting a different gating instruction to the control unit after detecting a different input voltage.

As stated above, the integrated LED module in accordance with the present invention has the following beneficial effects:

Firstly, as an LED module and a drive circuit are combined into one-piece, they can be assembled to a heat sink in a simple connection manner, to achieve a three-in-one effect, so that the overall size and weight are greatly reduced, thereby effectively reducing the lamp size corresponding thereto, saving materials and saving costs.

Moreover, the number of electronic components is reduced a lot in the drive circuit, and restrictive elements such as electrolytic capacitors and inductors are removed; therefore, it is possible to combine lines and load and make a standardized light source, which can reduce the size of the entire product; and the lamps can be combined into products with different power by using the standardized light source, thereby reducing design costs, shortening a product development cycle and reducing product costs, shortening time to market, and further controlling product quality.

Illustration of element labels

| | |
|---|---|
| 10 | LED module |
| 11, 24 | heat sink |
| 12 | power supply shell |
| 121 | EMI unit |
| 122 | A/D conversion unit |
| 123 | input and output isolation unit |
| 124 | protection unit |
| 125 | PFC power supply |
| 13 | light-transmitting shade |
| 14 | lid body |
| 15 | suspension member |
| 20 | light-transmitting plate |
| 200 | built-in space |
| 201 | flange |
| 202 | through-hole |
| 21 | LED array |
| 210 | LED |
| 22 | drive circuit |
| 220 | electronic component |
| 221 | power supply module |
| 222 | control module |
| 23 | circuit board |
| 240 | heat-conducting surface |
| 241 | heat-dissipation fin |
| 242 | screw hole |
| 25 | heat-conducting substrate |
| 26 | seal ring |
| 27 | control panel |
| 28 | screw |

DETAILED DESCRIPTION OF THE PREFERRED EMBODIMENTS

Implementation of the present invention is described below through specific embodiments, and those skilled in the art can easily understand other advantages and efficacy of the present invention according to the content disclosed in the specification.

Please refer to FIG. 3 to FIG. 6. It should be noted that, the structure, scale, size and the like depicted in the accompanying drawings of the specification are only to cooperate with the content disclosed in the specification for those skilled in the art to understand and read, but are not intended to limit qualifications with which the present invention can be implemented, which thus do not have any technically substantial meaning, and any structural modification, change in the scaling relationship or adjustment to the size should fall with the scope that can be covered by the technical content disclosed in the present invention without affecting the efficacy that can be produced by the present invention and the objects that can be achieved. Meanwhile, the terms "up", "down", "left", "right", "middle" and "a/an" cited in the specification are also to facilitate clear description, but are not intended to limit the scope of implementation of the present invention, and changes or adjustment to the relative relationship thereof should be regarded as the scope of the implementation of the present invention if there is no substantial change in the technical content.

Embodiment 1

Figure 1:
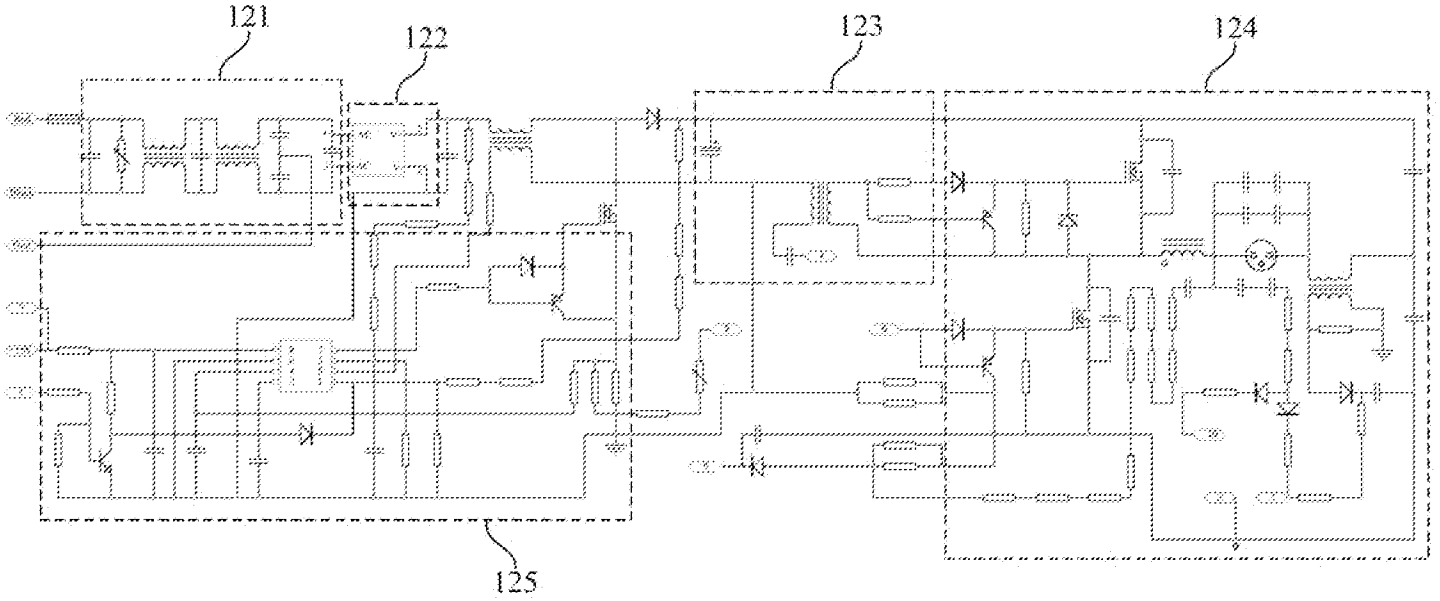
FIG. 1 is a schematic diagram of a principle of a drive circuit of a conventional LED module with a 3-5V forward voltage.
Figure 2:
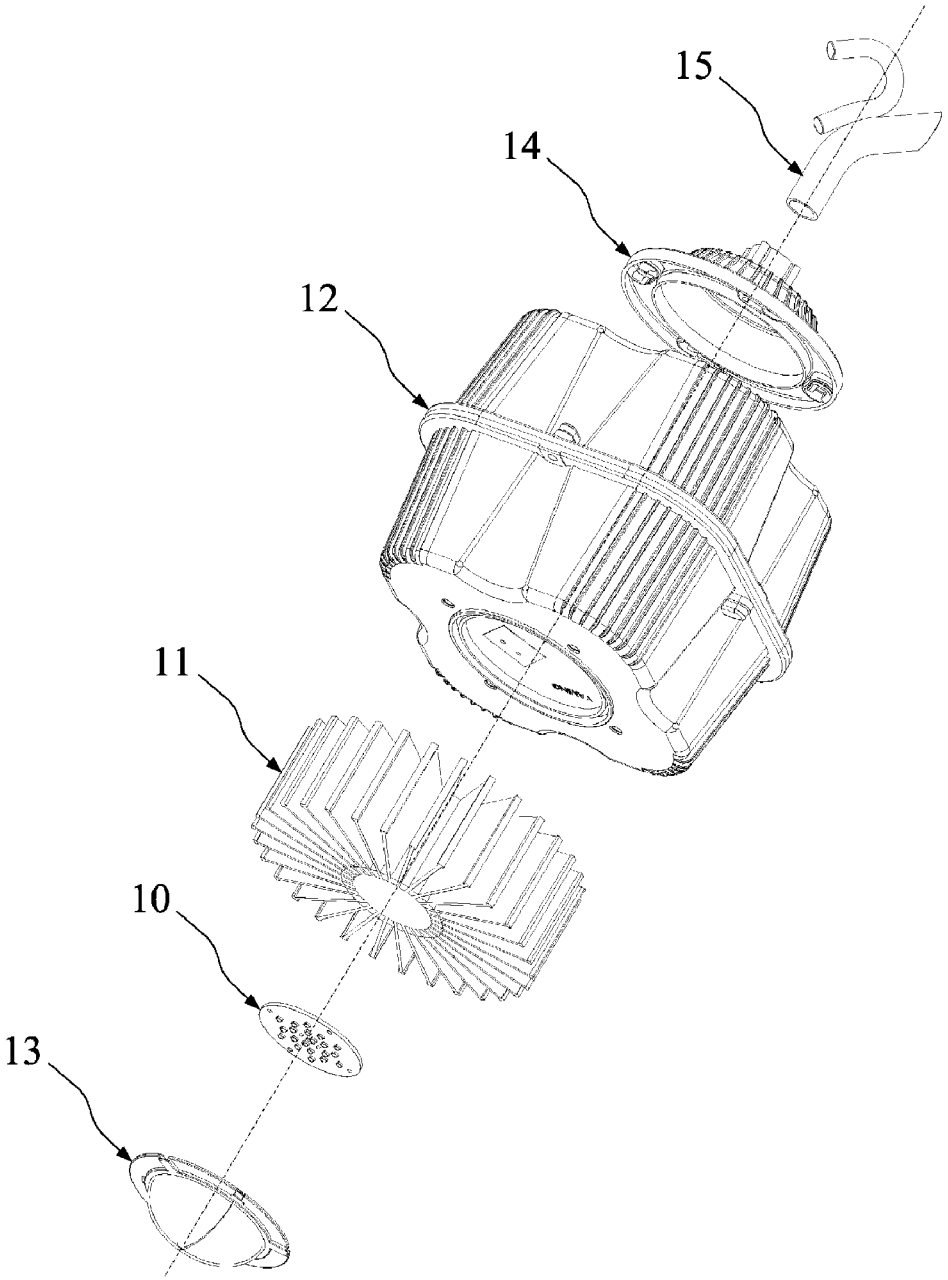
FIG. 2 is a schematic structural exploded view of a conventional LED lamp.
Figure 3:
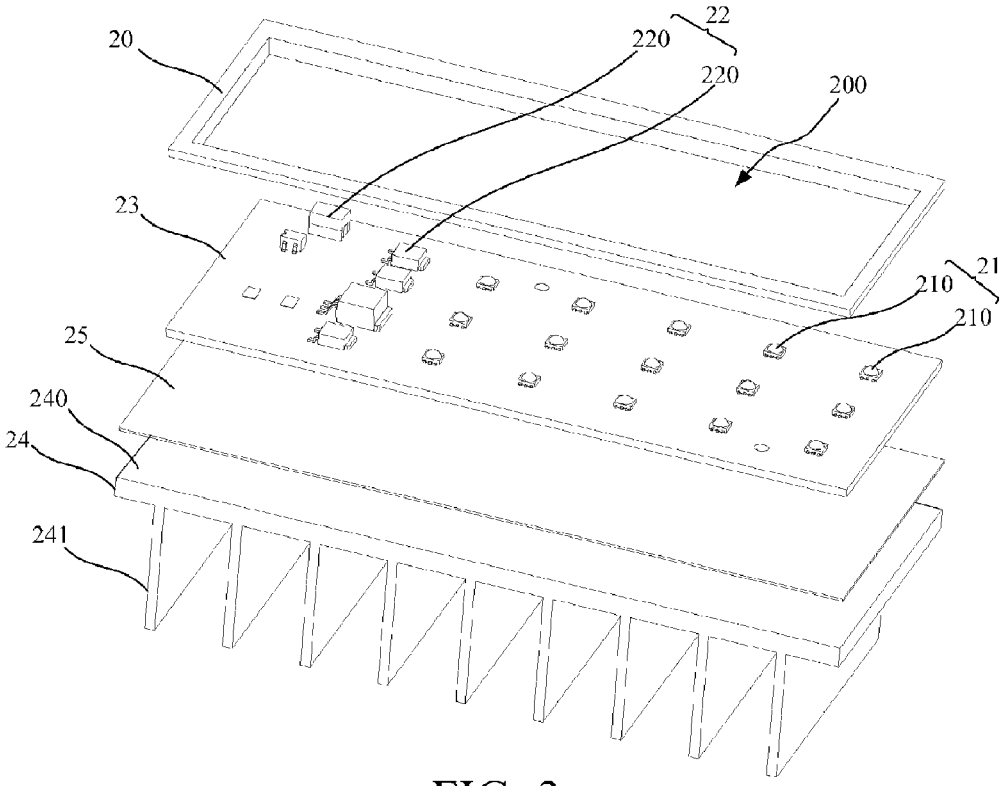
FIG. 3 is a schematic structural exploded view of an integrated LED module in accordance with the present invention.
Figure 4:
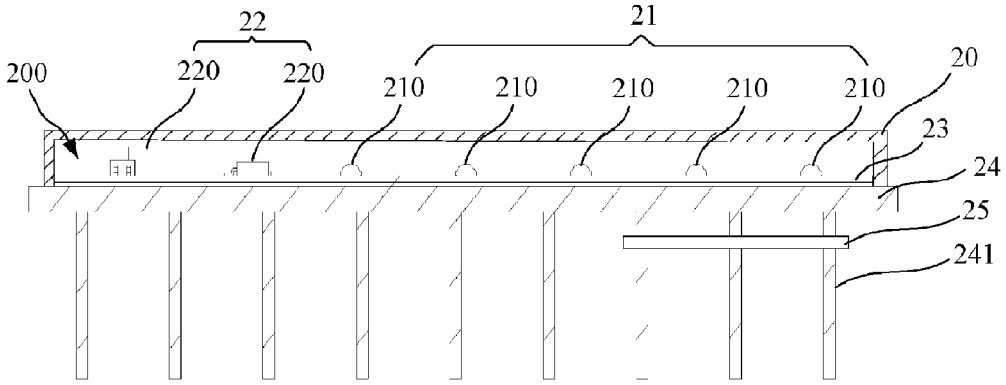
FIG. 4 is a schematic structural sectional view of assembly of an integrated LED module in accordance with the present invention.

Referring to FIG. 3 and FIG. 4, FIG. 3 is a schematic structural exploded view of an integrated LED module in accordance with the present invention, and FIG. 4 is a schematic structural sectional view of assembly of an integrated LED module consistent with the present invention. As shown in FIG. 3 and FIG. 4, the present invention provides an integrated LED module, applied to street lighting, industrial lighting and commercial lighting, specifically, for example, stadiums, event plazas, parks and other outdoor venue lighting, or used in many occasions and fields such as lighting and rendering of city beautification buildings. Specifically, the integrated LED module in accordance with the present invention can be assembled into lamps so as to realize convenience and diversification of design and manufacturing of LED lamps. The LED module at least comprises: a light-transmitting plate 20, and LED array 21, a drive circuit 22, a heat sink 24, and a control panel 27.

The light-transmitting plate 20 has a heat-conducting substrate 25, and a transparent package that covers the heat-conducting substrate 25 and has a built-in space 200; specifically, a material of the transparent package comprises plastic, glass, and the like, and the heat-conducting substrate 25 may be made of, for example, metal, FR4, ceramic, silicon or the like. In this embodiment, the heat-conducting substrate 25, for example, is an aluminum alloy plate with good thermal conductivity, the transparent package, for example, is a transparent plastic encloser with good light transmission properties, and in more details, the transparent plastic encloser may be a light-transmitting shade having a focalization or scattered reflection function.

Figure 5:
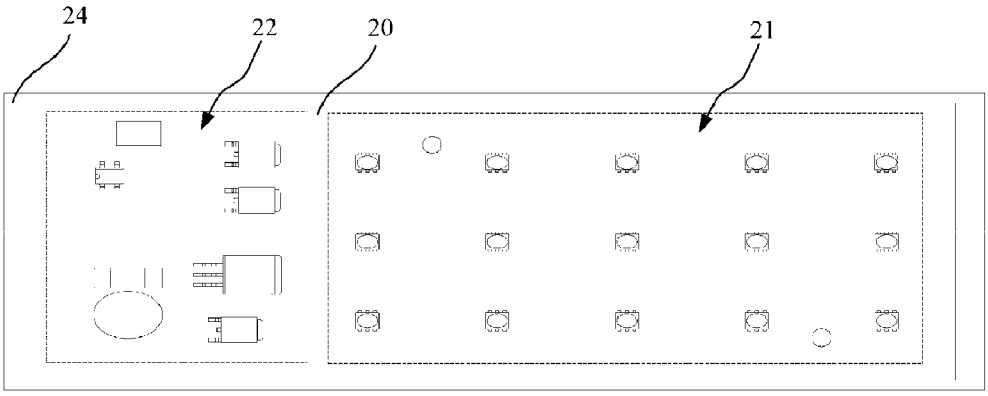
FIG. 5 is a top view of an integrated LED module in accordance with the present invention.

Refer to FIG. 5, which is a top view of an integrated LED module in accordance with the present invention, and as shown in FIG. 5, the LED array 21 is laid on a circuit board 23, and is sealed in the light-transmitting plate 20 by the transparent package. In this embodiment, each LED in the LED array 21 is an LED 210 with power of 1 W-4 W, and in this embodiment, an LED whose power is preferably 1.5 W is used as an example for illustration. A plurality of LEDs 210 is connected in parallel to form one or more parallel groups, and then the parallel groups are connected in series to form the LED array 21.

Refer to FIG. 5, in this embodiment, the LED array 21 is a rectangular array arranged by a plurality of singly packaged LEDs 210, but the present invention is not limited thereto, and in other implementation manners, the LED array 21 may also be a square, a rectangular, a circular or an elongated array arranged by a plurality of singly packaged LEDs, or a square, a rectangular, a circular or an elongated array arranged by LEDs packaged by LED COBs.

Figure 6:
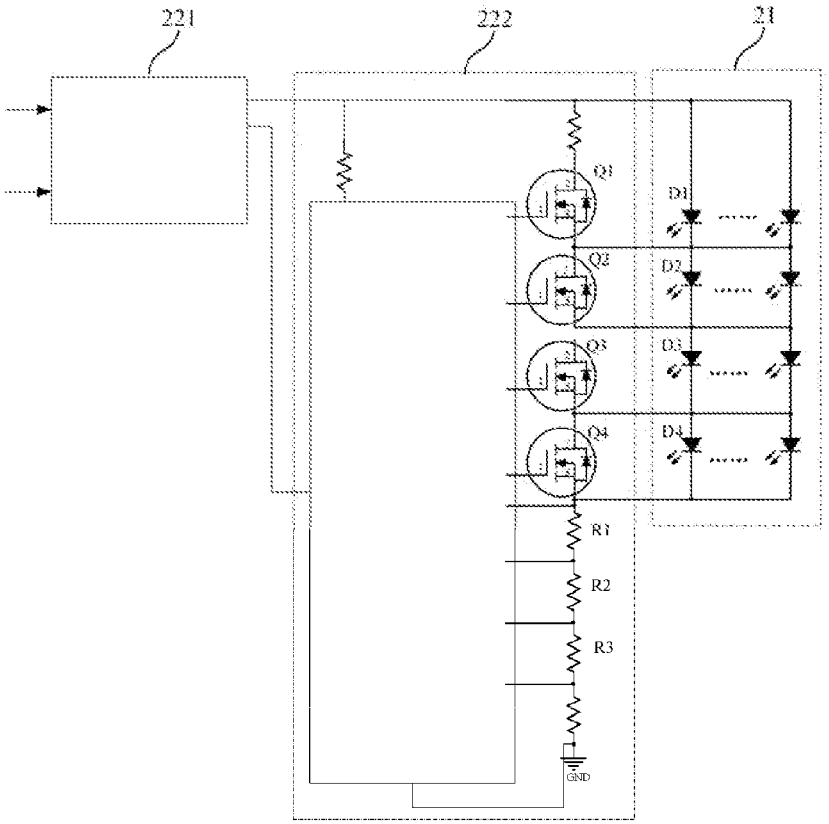
FIG. 6 is a view of a circuit principle of an integrated LED module in accordance with the present invention.

The drive circuit 22 is laid on the circuit board 23, sealed in the light-transmitting plate 20 by the package, electrically connected to the LED array 21 by the circuit board 23, and used for converting an external power supply into a 12V-75V forward voltage that drives each LED 210 in the LED array, so as to drive the LED 210 to be turned on. In this embodiment, the drive circuit 22 preferably converts the external power supply into a 50V forward voltage to drive each LED 210 in the LED array 21. Refer to FIG. 6, which is a view of a circuit principle of an integrated LED module in accordance with the present invention. As shown in FIG. 6, the drive circuit 22 comprises a plurality of electronic elements 220, and the plurality of electronic elements 220 forms a power supply module 221 and a control module 222.

The power supply module 221 is connected to an external AC or DC power supply and the LED array 21, comprises a rectifying unit and an overcurrent overvoltage protection unit connected to the rectifying unit, and is used for converting the external power supply into a 12V-75V forward voltage that drives each LED in the LED array, so as to drive each LED 210 to be turned on. In this embodiment, the power supply module 221 is directly connected to AC main power, for example, a 220V AC power supply generally used in China, a 230V AC power supply generally used in Europe, a 110V AC power supply generally used in North America, or a 277V AC power supply generally used in other regions.

The control module 222 is connected between the power supply module 221 and the LED array 21, and comprises a plurality of gating switches, a control unit and a detection unit, where the gating switches are disposed corresponding to the parallel groups and used for conducting or cutting off power supply loops of the parallel groups, the control unit is used for controlling the gating switches to perform a conduction or cutoff operation according to a detected input voltage, and the detection unit is used for outputting a different gating instruction to the control unit after detecting a different input voltage. In an actual application example, the control unit, for example, is a control chip comprising a peripheral circuit thereof, and the plurality of gating switches is a transistor Q1, a transistor Q2, a transistor Q3, and a transistor Q4. The LED array 21 is a series circuit formed by a plurality of parallel groups (for example, the parallel groups D1, D2, D3, D4 shown in FIG. 6).

In an example shown in FIG. 6, the plurality of gating switches is a transistor Q1, a transistor Q2, a transistor Q3, and a transistor Q4 that can divide a drive voltage input to the LED array 21 into four stages to take control. When the detection unit detects that the drive voltage input to the LED array 21 reaches a first-stage LED voltage, the control unit makes the transistor Q1 switched on and grounded, so that LED D1 is conducted to the ground; when the detection unit detects that the drive voltage input to the LED array 21 reaches a second-stage LED voltage, the control unit makes the transistor Q1 turned off and the transistor Q2 turned on and grounded, so that LED D1 and D2 are conducted to the ground; when the detection unit detects that the drive voltage input to the LED array 21 reaches a third-stage LED voltage, the control unit makes the transistor Q1 and the transistor Q2 turned off and the transistor Q3 turned on and grounded, so that LED D1, D2 and D3 are conducted to the ground; and when the detection unit detects that the drive voltage input to the LED array 21 reaches a fourth-stage LED voltage, the control unit makes the transistor Q1, the transistor Q2 and the transistor Q3 turned off and the transistor Q4 turned on and grounded, so that LED D1, D2, D3 and D4 are conducted to the ground at the same time. By means of this control manner, the efficiency and a power factor of the power supply can be improved.

The heat sink 24 has a heat-conducting surface 240 clinging to the light-transmitting plate 20 and a plurality of heat-dissipation fins 241 integrally formed with the heat-conducting surface 240. In this embodiment, the heat sink 24 is made of, for example, aluminum with good thermal conductivity, and is formed by means of, for example, aluminum extrusion, aluminum die casting, aluminum lamps, and the like.

In this embodiment, the light-transmitting plate 20 clings to the heat-conducting surface 240 of the heat sink 24 by screw locking, bonding or fastening. Moreover, the heat-conducting surface 240 of the heat sink 24 and the light-transmitting plate 20 have a heat-conducting medium (not shown) therebetween, where the heat-conducting medium is a heat-conducting glue, a heat-conducting grease or a heat-conducting pad.

The control panel 27 is disposed on the heat-dissipation fins 241, electrically connected to the drive circuit 22, and used for outputting a control instruction to the drive circuit 22 to instruct it to control the LED array 21 to be turned on or turned off, or to adjust brightness or color temperature. Specifically, the control panel 27 comprises a wired or wireless communication module, used for controlling, according to a control instruction sent by a remote control center, the LED array 21 to be turned on or turned off, or to adjust brightness or color temperature.

In this embodiment, the plurality of heat-dissipation fins 241 of the heat sink 24 have notches (not shown), to form slots (not shown) for retaining the control panel 27. In other implementation manners, the control panel 27 may also be fixed to another position of the LED module, for example, be integrated inside the light-transmitting plate 20.

Embodiment 2

Figure 7:
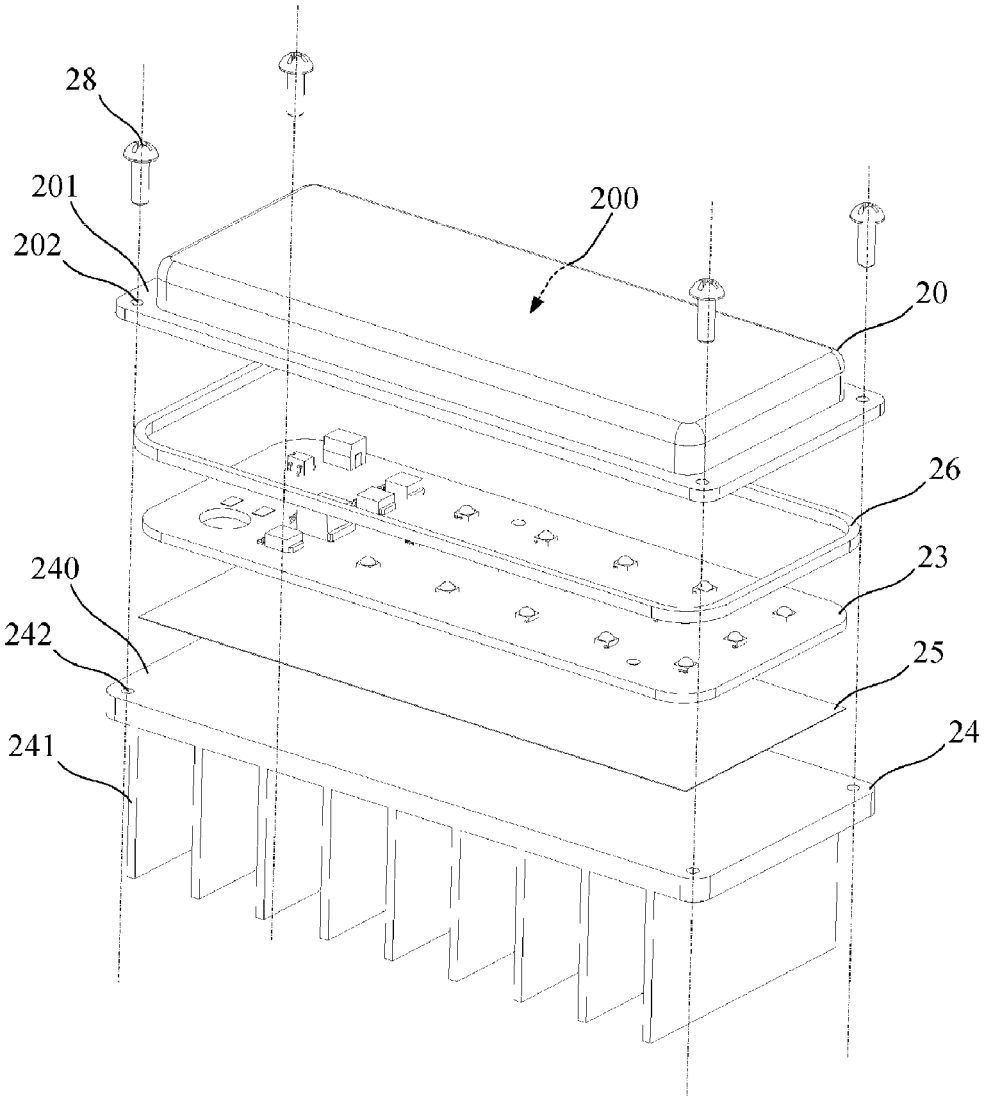
FIG. 7 is a schematic structural exploded view of an integrated LED module in accordance with another embodiment of the present invention.

Refer to FIG. 7, which is a schematic structural exploded view of another embodiment of an integrated LED module in accordance with the present invention. As shown in FIG. 7, the LED module at least comprises: a light-transmitting plate 20, an LED array 21, a drive circuit 22, a circuit board 23, a heat sink 24, a heat-conducting substrate 25, and a seal ring 26.

The light-transmitting plate 20 has a heat-conducting substrate 25, and a transparent package that covers the heat-conducting substrate 25 and has a built-in space 200; specifically, a material of the transparent package comprises plastic, glass, and the like, and the heat-conducting substrate 25 may be made of, for example, metal, FR4, ceramic, silicon and the like. In this embodiment, the heat-conducting substrate 25, for example, is an aluminum alloy plate with good thermal conductivity.

In this embodiment, a periphery of the transparent package has a flange 201, four corners of the flange 201 are provided with through holes 202. The transparent package, for example, is a transparent plastic encloser with good light transmission properties, and in more details, the transparent plastic encloser may be a light-transmitting shade having a focalization or scattered reflection function.

Figure 8:
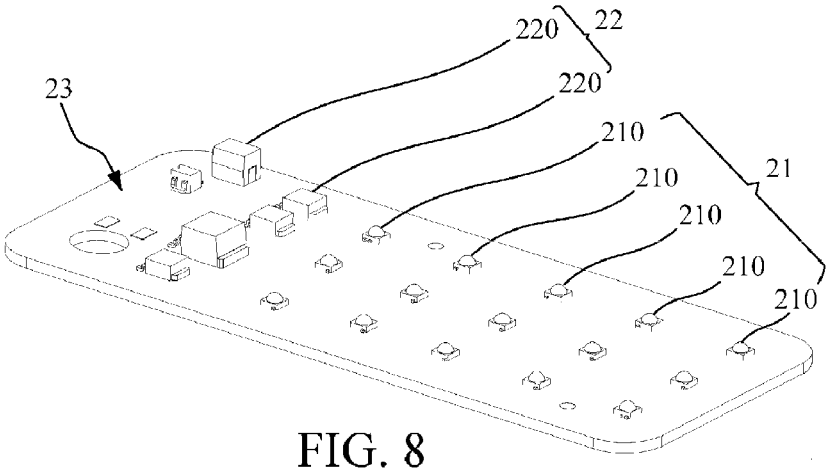
FIG. 8 is a schematic diagram of a circuit board arranged with a LED array and a driver circuit, in accordance with the present invention.

Refer to FIG. 8, which is a schematic view of a circuit board provided with an LED array and a drive circuit in the present invention. As shown in FIG. 8, the LED array 21 is laid on a circuit board 23, and is sealed in the light-transmitting plate 20 by the transparent package; in this embodiment, each LED in the LED array 21 is an LED 210 with power of 1 W-4 W, and in this embodiment, an LED whose power is preferably 1.5 W is used as an example for illustration. A plurality of LEDs 210 are connected in parallel to form one or more parallel groups, and then the parallel groups are connected in series to form the LED array 21.

In this embodiment, the LED array 21 is a rectangular array arranged by a plurality of singly packaged LEDs 210, but the present invention is not limited thereto, and in other implementation manners, the LED array 21 may also be a square, a rectangular, a circular or an elongated array arranged by a plurality of singly packaged LEDs, or a square, a rectangular, a circular or an elongated array arranged by LEDs packaged by LED COBs.

The drive circuit 22 is laid on the circuit board 23, sealed in the light-transmitting plate 20 by the package, electrically connected to the LED array 21 through the circuit board 23, and used for converting an external power supply into a 12V-75V forward voltage that drives each LED 210 in the LED array, so as to drive the LED 210 to be turned on. In this embodiment, the drive circuit 22 preferably converts the external power supply into a 50V forward voltage to drive each LED 210 in the LED array 21. The drive circuit 22 comprises a plurality of electronic elements 220, and the plurality of electronic elements 220 forms a power supply module and a control module. It should be noted that, a principle of the drive circuit in this embodiment is the same as that in Embodiment 1, which is not repeated herein for simplicity.

The heat sink 24 has a heat-conducting surface 240 clinging to the light-transmitting plate 20 and a plurality of heat-dissipation fins 241 integrally formed with the heat-conducting surface 240. The heat sink 24 is made of, for example, aluminum with good thermal conductivity, which is formed by means of, for example, aluminum extrusion, aluminum die casting, aluminum lamps and the like. In this embodiment, the heat-conducting surface 240 of the heat sink 24 has screw holes 242 corresponding to the through holes 202. The light-transmitting plate 20 is locked to the heat sink 24 by screws 28, which will be detailed later.

Figure 9:
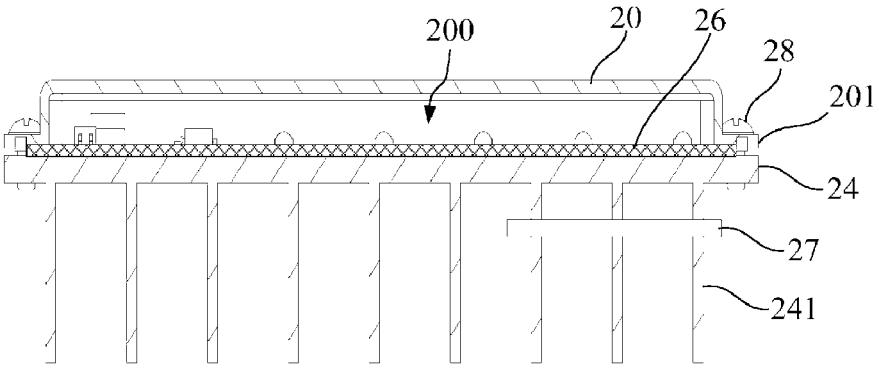
FIG. 9 is a schematic structural sectional view of assembly of an integrated LED module in accordance with another embodiment of the present invention.
Figure 10:
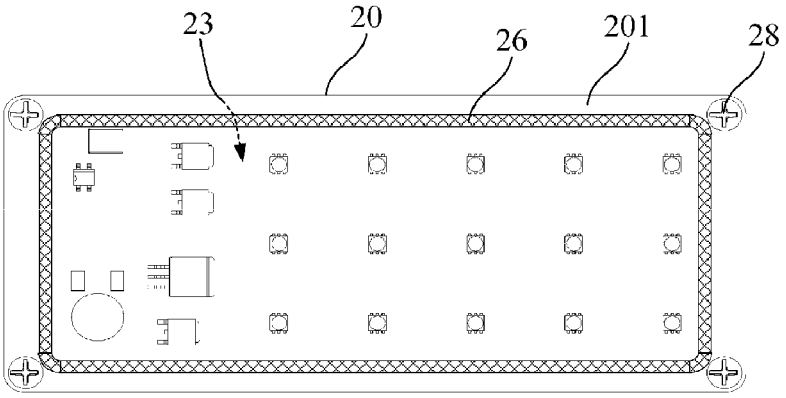
FIG. 10 is a top view of an integrated LED module in accordance with another embodiment of the present invention.

Refer to FIG. 9 and FIG. 10, FIG. 9 is a schematic structural sectional view of assembly of another embodiment of an integrated LED module in accordance with the present invention, and FIG. 10 is a top view of another embodiment of an integrated LED module in accordance with the present invention. As shown in FIG. 9 and FIG. 10, the seal ring 26 is circularly disposed on the periphery of the circuit board 23 and the heat-conducting substrate 25, and is pressed between the transparent package and the heat sink 24 to seal a gap therebetween. In an application example, the seal ring 26, for example, is a rubber material or a silicone material with an elastic property and high-temperature resistance.

Specifically, the seal ring 26 is pressed between the flange of the transparent package and the heat-conducting surface 240 of the heat sink 24 to seal a gap therebetween, and in this embodiment, the seal ring 26 is disposed in a manner in which the screws 28 penetrate the through holes 202 of the transparent package and are locked to the screw holes 242 of the heat sink 24, so that the seal ring is pressed between the transparent package and the heat sink 24 to seal a gap therebetween. As the seal ring is directly disposed on the LED module in the lamp, an internal circuit of a conventional lamp is prevented from being damaged due to encloser seepage. Compared with the conventional lamp that has difficulty in directly waterproofing an LED light source due to a complicated and large-size drive circuit, a lamp formed by the LED module in accordance with the present invention has good waterproof performance.

From the above, the LED module in accordance with the present invention has changed the traditional waterproofing concept, and first proposes a concept of directly disposing a waterproof structure on a built-in module of a lamp, so that an internal circuit of a conventional lamp is prevented from being damaged due to encloser seepage, and thus the lamp having the LED module in accordance with the present invention can be applied in more environments.

To sum up, the LED module in accordance with the present invention combines an LED array and a drive circuit into one-piece, they can be assembled to a heat sink in a simple connection manner, to achieve a three-in-one effect, so that the overall size and weight are greatly reduced, thereby effectively reducing the lamp size corresponding thereto, saving materials and saving costs; moreover, the number of electronic components is reduced a lot in the drive circuit, and restrictive elements such as electrolytic capacitors and inductors are removed; therefore, it is possible to combine lines and load and make a standardized light source, which can reduce the size of the entire product; and the lamps can be combined into products with different power by using the standardized light source, thereby reducing design costs, shortening a product development cycle and reducing product costs, shortening time to market, and further controlling product quality. Therefore, the present invention effectively overcomes the defects in the prior art and has a high industrial utilization value.

The above embodiments are merely for the purpose of exemplarily describing the principles and effects of the present invention, but are not intended to limit the present invention. Any person skilled in the art can make modifications or variations to the embodiments without departing from the spirit and scope of the present invention. Therefore, all equivalent modifications and variations completed by those with ordinary skill in the art without departing from the spirit and technical concepts disclosed in the present invention shall fall within the claims of the present invention.

What is claimed is:

1. An integrated LED module comprising:

a light-transmitting plate, having a heat-conducting substrate, and a transparent package that covers the heat-conducting substrate and has a built-in space;

an LED array, laid on a circuit board and sealed in the light-transmitting plate by the transparent package;

a drive circuit, laid on the circuit board, sealed in the light-transmitting plate by the transparent package, electrically connected to the LED array through the circuit board, and used for converting an external power supply into a 12V-75V forward voltage that drives each LED in the LED array; and a heat sink, having a heat-conducting surface clinging to the light-transmitting plate and a plurality of heat-dissipation fins integrally formed with the heat-conducting surface;

power of each LED in the LED array is 1W-4W, and the LED array is a square, rectangular, circular or elongated array arranged by a plurality of singly packaged LEDs, or a square, rectangular, circular or elongated array arranged by LEDs packaged by LED COB;

the LED array comprises a plurality of parallel groups formed by a plurality of LEDs connected in parallel, where the parallel groups are connected in series;

a power supply module, connected to an external alternating current or direct current power supply and the LED array, comprising a rectifying unit and an overcurrent overvoltage protection unit connected to the rectifying unit, and used for converting the external power supply into a 12V-75V forward voltage that drives each LED in the LED array; and a control module, connected between the power supply module and the LED array, and comprising a plurality of gating switches and a control unit, where the gating switches are disposed corresponding to the parallel groups and used for conducting or cutting off power supply loops of the parallel groups, and the control unit is used for controlling the gating switches to perform a conduction or cutoff operation according to a detected input voltage.

2. The integrated LED module as in claim 1, further comprising a control panel disposed on the heat-dissipation fins, which is electrically connected to the drive circuit and used for outputting a control instruction to the drive circuit, so that the drive circuit is in control of the LED array to be turned on or turned off, or to adjust brightness or color temperature.

3. The integrated LED module as in claim 2, wherein the plurality of heat-dissipation fins of the heat sink have notches, to form slots for retaining the control panel.

4. The integrated LED module as in claim 1, wherein a periphery of the transparent package has a flange, four corners of the flange are provided with through holes, and the heat-conducting surface of the heat sink has screw holes corresponding to the through holes.

5. The integrated LED module as in claim 4, further comprising a seal ring, which is circularly disposed on the periphery of the circuit board and the heat-conducting substrate, and is pressed between the transparent package and the heat sink to seal a gap therebetween.

6. The integrated LED module as in claim 5, further comprising a plurality of screws penetrating the through holes of the transparent package and locked to the screw holes of the heat sink.

7. The integrated LED module as in claim 1, wherein the light-transmitting plate clings to the heat-conducting surface of the heat sink by screw locking, bonding or fastening.

8. The integrated LED module as in claim 1, wherein the heat-conducting surface of the heat sink and the light-transmitting plate have a heat-conducting medium therebetween, where the heat-conducting medium is a heat-conducting glue, a heat-conducting grease or a heat-conducting pad.

9. The integrated LED module as in claim 1, wherein the control module further comprises a detection unit used for outputting a different gating instruction to the control unit after detecting a different input voltage.

* * * * *